United States Patent [19]

Gardner, Sr. et al.

[11] Patent Number: 4,846,952

[45] Date of Patent: Jul. 11, 1989

[54] FLAT PLATE ELECTROLYSIS CELL FRAME SEPARATOR AND METHOD

[75] Inventors: Gary L. Gardner, Sr., Lake Jackson; John R. Pimlott, Sweeney; Hiep D. Dang; Roy L. Hicks, both of Lake Jackson, all of Tex.

[73] Assignee: The Dow Chemical Company, Midland, Mich.

[21] Appl. No.: 219,951

[22] Filed: Jul. 15, 1988

[51] Int. Cl.[4] ..... C25B 9/00

[52] U.S. Cl. ..... 204/279; 204/253; 204/267

[58] Field of Search ..... 204/253–258, 204/263–266, 279, 267; 210/230

[56] References Cited

U.S. PATENT DOCUMENTS

| | | | |
|---|---|---|---|
| 3,574,083 | 4/1971 | Pewitt | 204/263 X |
| 4,105,560 | 5/1978 | Fismer | 210/230 |
| 4,430,179 | 2/1984 | Ford et al. | 204/257 X |
| 4,541,911 | 9/1985 | Burgess et al. | 204/253 |
| 4,756,817 | 7/1988 | Hicks et al. | 204/279 X |

*Primary Examiner*—Donald R. Valentine

*Attorney, Agent, or Firm*—Joe R. Prieto

[57] ABSTRACT

An electrolysis flat plate cell frame separating device for changing out one or more cells, gaskets and/or membranes from a stack in a flat plate membrane cell electrolyzer without having to shift other cells one at a time and a method of use.

4 Claims, 4 Drawing Sheets

FLAT PLATE ELECTROLYSIS CELL FRAME SEPARATOR AND METHOD

BACKGROUND OF THE INVENTION

This invention relates to an apparatus and method for separating flat plate electrolysis cell frame members apart and more particularly to an apparatus and method for separating the frame members apart from a series of cells in an electrolyzer to remove a single cell, gasket or membrane from the electrolyzer without having to shift the cell frame members of the electrolyzer one at a time.

When a single damaged cell frame member, gasket or membrane needs to be serviced or removed from a series of cell frame members in an electrolyzer, it is known to shift each cell frame, one at a time, using a shifter mechanism to get at the cell frame member, gasket or membrane to be worked on. An electrolyzer can contain up to as many as 120 cell frame members and shifting each cell frame is time consuming and requires shutting down the electrolyzer for a period of time. In addition, it is not uncommon, using this shifting method, to ruin several membranes worth up to several thousand dollars each and regasketing of the series of cell frame flanges with new gaskets.

Membranes can be ruined for example if the membrane is exposed to the atmosphere and it drys out. The membrane can dry in the length of time it takes to install the membrane in an electrolyzer. When a membrane drys it tends to shrink for example about 6–8 percent and such shrinkage pulls the edges of the membrane which leads to ripping of the membrane. Once the membrane shrinks it is very difficult to realign the membrane and gaskets exactly against the cell frame member as it was before it was disturbed during shifting of the cell frame members. Thus, the compressed gasket portion of the membrane may be positioned in the active area of the cell. The compressed part of the membrane exposed to the active area of the cell is a site for failure and electrolyte leakage within the cell.

It is therefore desired to provide a novel method and device for removing a cell frame, gaskets or membrane from a series of cell frames in an electrolyzer without having to shift the cell frame members of an electrolyzer unit one at a time. It is further desired to provide a novel method and device for removing a cell frame, gasket or membrane from a series of cell frames in an electrolyzer unit without damaging the membrane and gaskets of the electrolyzer.

SUMMARY OF THE INVENTION

One aspect of the present invention is directed to a separator device for removing one or more cell frame members, gaskets or membranes from a plurality of cell frame members comprising:

a. at least a first bracket member for clamping a plurality of cell frame members together;

b. at least a second bracket member for clamping a second plurality of cell frame members together; and c. at least a first hydraulic cylinder interposed between the first and second bracket members for separating the first and second brackets apart whereby the cell frames are moved away from each other.

Another aspect of the present invention is directed to a process for removing one or more cell frame members, gaskets or membranes from a plurality of cell frame members comprising:

clamping a first plurality of cell frame members together;

clamping a second plurality of cell frame members together;

interposing at least a first hydraulic cylinder between the first and second plurality of cell frame members; and actuating the hydraulic cylinder to separate the first and second plurality of cell frame members apart whereby the cell frames members are moved away from each other.

DETAILED DESCRIPTION OF THE PREFERRED EMBODIMENT(S)

Figure 1:
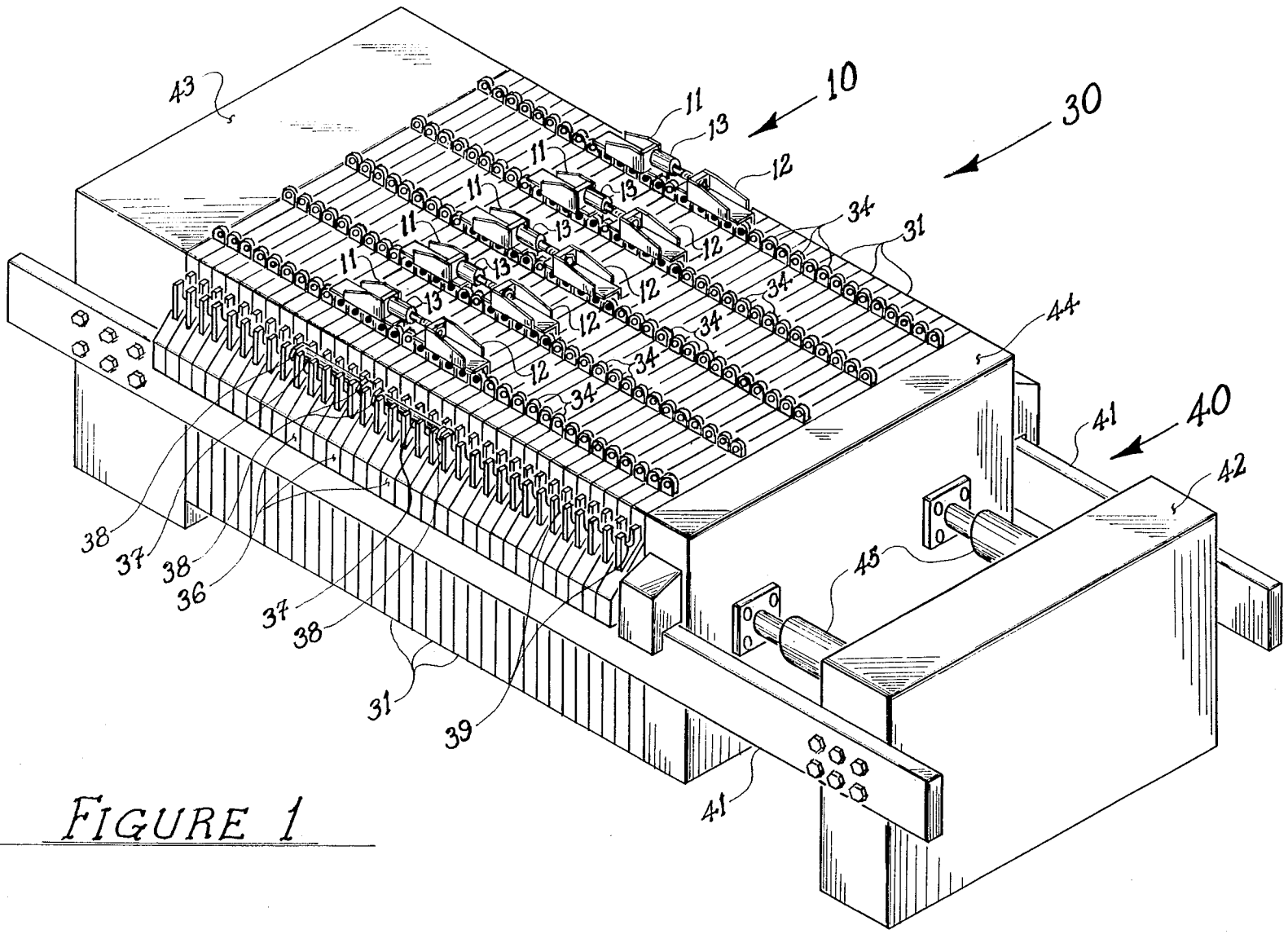
FIG. 1 is a perspective view showing an electrolyzer unit with the separator apparatus of the present invention.

With reference to FIGS. 1–5, there is shown a series of electrolytic cell units generally indicated by reference numeral 30, with a separator apparatus of the present invention, generally indicated by reference numeral 10. The separator 10 includes at least a first bracket member 11 for clamping a plurality of cell frame members 31 together; at least a second bracket member 12 for clamping a second plurality of cell frame members 31 together; and at least a first hydraulic cylinder 13 interposed between the first and second bracket 11 and 12, respectively, for separating the first and second brackets apart whereby the first and second plurality of cell frame members 31 are moved away from each other.

The separator 10 is mounted on a series of electrolytic cell units 30 comprising a plurality of cell frame members 31, gasket members 32 and membrane members 33 interposed and compressed between the frame members 31 with a conventional compressive force. The frame members 31 are generally planar and are of the filter press type. The electrode frame members may be bipolar or monopolar. Preferably, the electrode frame members are of the bipolar type. The electrode frame members 31 have top lifting lugs 34 for lifting the electrode frame members 31 so that the frame members 31 may be mounted onto the side rails 41 of a squeezer apparatus 40 as shown in FIG. 1. The frame members 31 also include bottom lifting lugs 35 (shown in FIGS. 2 and 3). The frame members 31 also have a hanger member 36 for supporting the frame member 31 on the side rails 41 of the squeezer apparatus 40. The squeezer apparatus 40 can be any conventional means for compressing the members together to provide a fluid-tight, i.e., liquid- and gas-tight seal between the cell frame members. For example, the squeezer apparatus 40 includes side units 41 supported by a pair of stationary platens 42 and 43. The squeezer 40 includes a mobile platen 44 mounted on side rails 41 for pressing the frame members 31 together with hydraulic pistons 45.

In carrying out one embodiment of the process of the present invention, the separator apparatus 10 is used to change out one or more cells, gaskets or membranes, preferably, after the cells are flushed and drained of any electrolyte. In its broadest scope, the process of the present invention is directed to removing any number of cell frame members, gaskets or membranes from a plurality of cell frame members by clamping a first plurality of cell frame members together with a bracket means; clamping a second plurality of cell frame members together with a bracket means; interposing at least a first hydraulic cylinder between the bracket means; and actuating the hydraulic cylinder to separate the bracket means such that the first and second plurality of cell frame members are separated apart and whereby the cell frames members are moved away from each other.

The present invention will be described more specifically with reference to replacing, for example, a single damaged cell frame member, indicated in FIG. 2 as cell frame member "X" having an anode side and a cathode side. However, it is to be understood that any number of cell frame members, gaskets or membranes for any desired reason may be removed from other cell frame members in accordance with the present invention.

Figure 5:
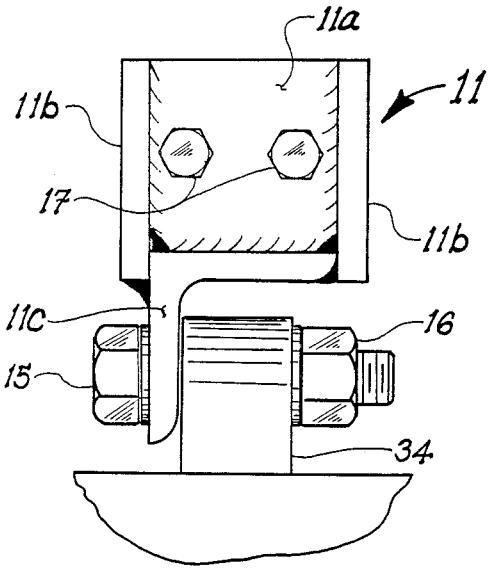
FIG. 5 is an end view of the cylinder mount of the present invention installed on an electrolyzer.

A plurality of bracket members and hydraulic members are preferably used in the present invention. A first top bracket 11 is placed on top of a plurality of cell frame members 31 and attached to any number of top lifting lugs 34, in this instance, for example, the number of cell frame members 31 is five as shown in FIGS. 2 and 3. Optionally, a means for fastening more cells to the 5-bracketed cells may be used, such as an adjustable hoist (not shown). The first top brackets 11 are removably mounted on the top lifting lugs 34 of the cell frame members 31 on the anode side of cell frame member "X." A removable fastening member such as threaded bolts 15 and nuts 16 (shown in FIG. 5 is used to fasten the brackets 11 on the top lifting lugs 34 to prevent movement between the brackets 11 and the lifting lugs 34. A plurality of hydraulic cylinders 13 are then mounted on the first top brackets 11, for example, using removable threaded bolts 17 to attach the hydraulic cylinder 13 to the flat mounting plate portion 11*a* of bracket 11 as shown in FIG. 5. The mounting plate 11*a* is held by gussets 11*b* to a bracket base plate 11c. The base plate 11*c*, in this instance, is L-shaped when viewed in cross section but other configurations, such as a U-shaped member viewed in cross section, may be used.

Figure 6:
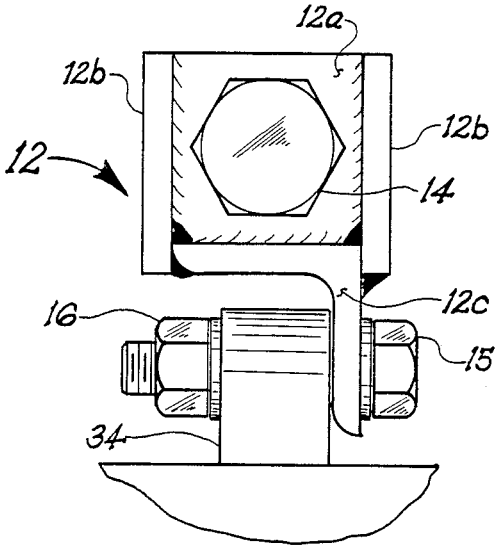
FIG. 6 is an end view of the adjustment screw of the present invention installed on an electrolyzer.

A second top bracket 12 (shown in FIG. 6) is placed on top of a second group of plurality of frame members 31 and attached to any number of top lifting lugs 34 of the second set of frame members 31. In this instance, for example, the number of cell frame members 31 can be five as shown in FIG. 2. The second top brackets 12 are removably mounted on the top lifting lugs 34 of the cell frame members on the cathode side of the cell frame member "X." Fastening members such as bolts 15 and nuts 16 are used to fasten the brackets 12 to the lifting lugs 34 to prevent movement between the brackets 12 and the lifting lugs 34. A plurality of top jack screws 14 are then removably mounted on the second top brackets 12, by threading the screw 14 through a threaded bore 14*a* in flat mounting plate portion 12*a* at bracket 12.

A plurality of first bottom brackets 21 are placed on a plurality of frame members 31 and attached to any number of bottom lifting lugs 35. In this instance, for example, the number of cell frame members 31 can be five, on the anode side of the cell frame member "X." Removable fastening members such as bolts 25 and nuts 26 are used to fasten the brackets 21 to the lifting lugs 35 to prevent movement between top brackets 21 and the lifting lugs 35. A second group of hydraulic cylinders 23 are then installed on the first bottom brackets 21.

A second plurality of bottom bracket 22 are placed on the bottom of a plurality of cell frame members 31 and attached to any number of bottom lifting lugs 35. In this instance, for example, the number of cell frame members 31 can be five on the cathode side of the cell frame member "X." Fastening members such as bolts 25 and nuts 26 are used to fasten the brackets 22 to the lifting lugs 35 to prevent movement between the brackets 22 and the lifting lugs 35. A second set of jack screws 24 are then installed on the second bottom brackets 22.

Figure 2:
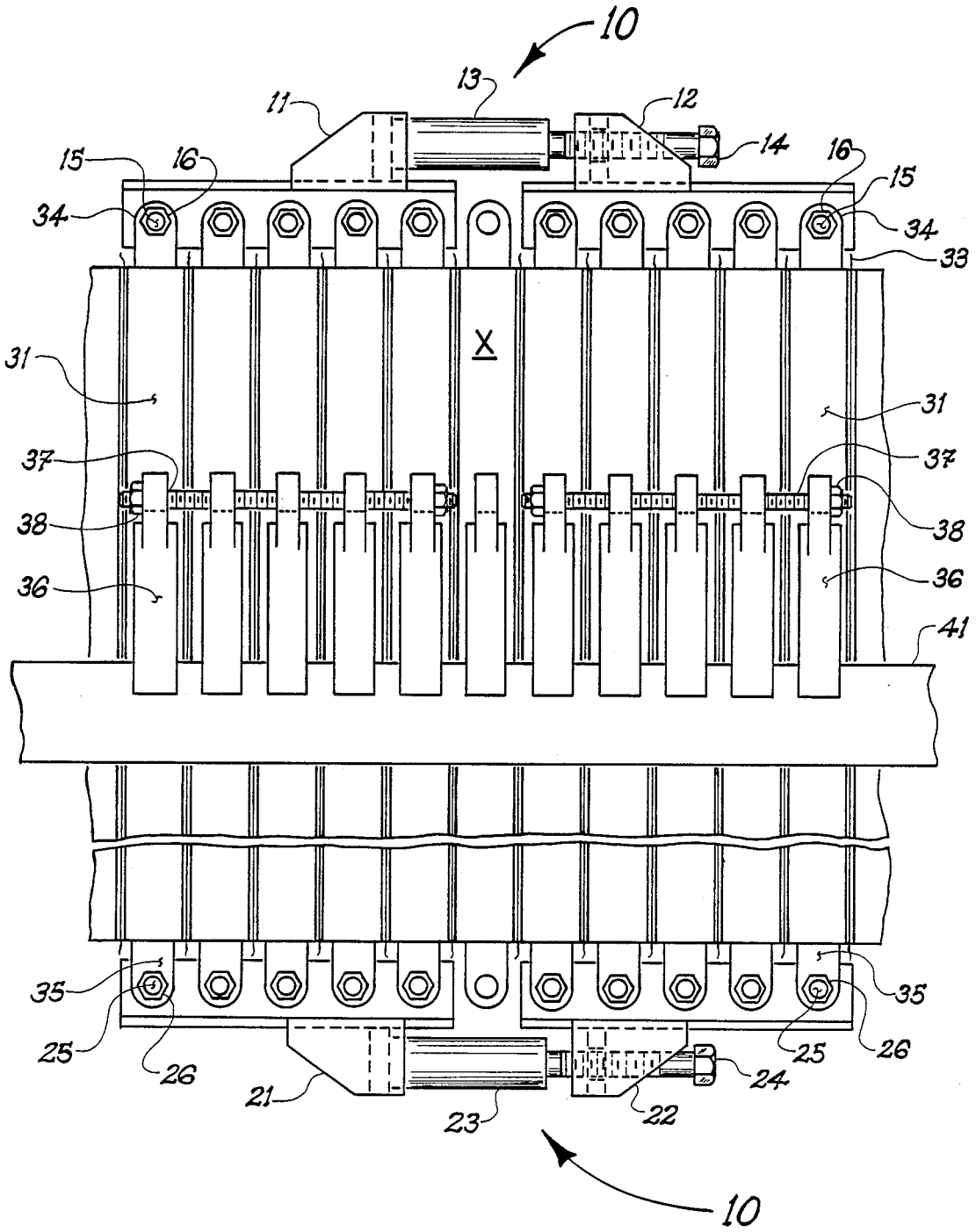
FIG. 2 is a side view showing the apparatus of the present invention installed on an electrolyzer.
Figure 3:
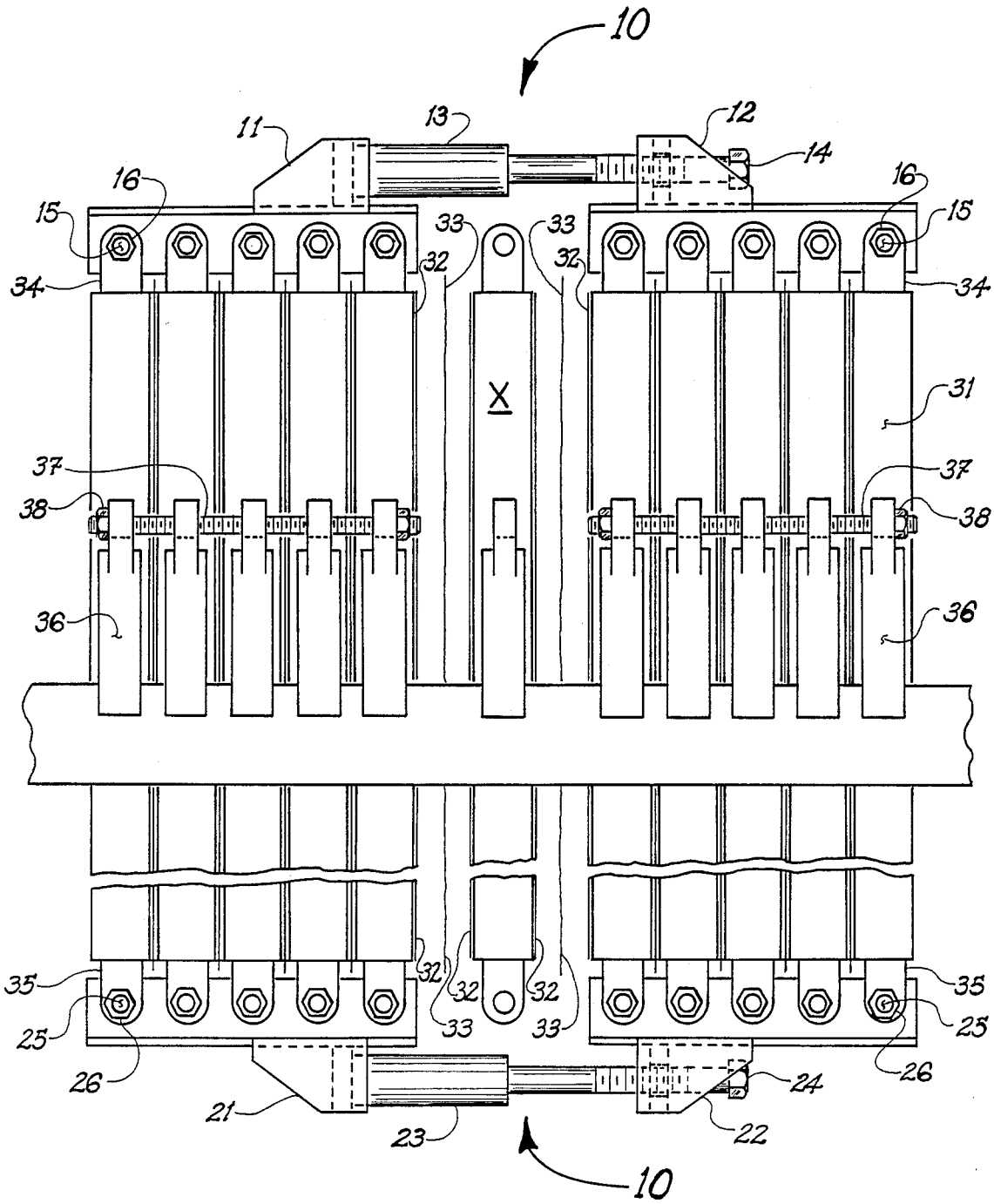
FIG. 3 is a side view showing electrolysis cell frame members separated by the separator apparatus of the present invention.
Figure 4:
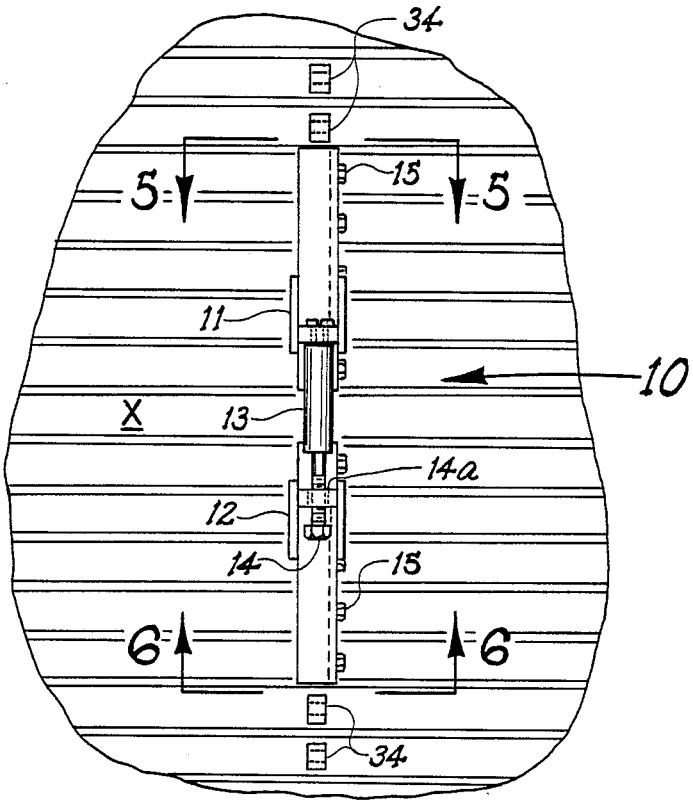
FIG. 4 is a top view showing the apparatus of the present invention installed on an electrolyzer.

With reference to FIGS. 1, 2 and 3, a group of threaded tie-rods 37 and nuts 38 may be installed on a rod receiving notch portion 39 integral with the hangers 36 of the both sets of 5-cell block bracketed as described above to more securely fasten the cells together.

In another embodiment the jack screws 14 and 24 may be omitted and the hydraulic cylinders 13 and 23 may contain a hydraulic push rod with an adjustable jack screw (not shown) attached to the end thereof to provide minor adjustments to take up the gap between the hydraulic rod and a flat mounting plate of brackets 12 and 22.

When the 5-cell blocks are securely fastened together on the top and bottom with brackets 11, 12, 21 and 22, and the hydraulic cylinders are in place, all of the hydraulic cylinders are then pressurized substantially simultaneously with a common hydraulic oil manifold, which in turn, pushes apart the 5-cell block on anode and cathode side of the cell frame member "X" moving all the cells away from cell frame member "X." Pressure is removed from the hydraulic pistons 45 such that the mobile platen 44 freely slides along rails 41. The mobile platen 44 can be retracted a predetermined distance away from the cell frame members 31 to allow the 5-block cells to split apart from cell frame member "X" and move toward the retracted mobile platen 44. The 5-cell blocks on the other side of cell frame member "X" applies force toward the stationary platen 43. When the 5-cell blocks move a predetermined distance, for example, about 4 inches away from cell frame member "X", the movement is stopped by de-pressurizing the hydraulic cylinders 13 and 23.

The gasket and membrane members can then be removed from the anode and cathode side of cell frame member "X" or optionally, the membrane on the anode side of cell frame member "X" can be taped against the cathode of the adjacent cell frame and the membrane on the cathode side of cell frame member "X" can be taped against the anode of the adjacent cell frame using, for example, duct tape to hold the membranes away from cell frame member "X". The membranes can then remain on the adjacent cell frames without removing them—provisions being made to keep the membranes from drying out.

The 5 top hydraulic cylinders are removed from the brackets to allow the removal of cell frame member "X" from between the two sets of 5-cell block frame members. Preferably, a lifting device and crane is used to lift the cell frame member "X" up and out of the series and to seat cell frame member "X" in a cell rack for inspection or repair.

It is to be understood that with appropriate brackets and/or cylinders, the cell stack may be split such that more than one cell frame member can be removed.

The lifting device and crane is then used to install a new cell frame member "Y" to replace the cell frame member "X". Cell frame member "Y" can be gasketed on its anode and/or cathode side or only one of its sides and membranes can be installed on each side of the cell frame member "Y".

The squeezer apparatus is then actuated to compress all of the cells including the new cell frame member "Y" for example up to about 700 psig to squeeze the gaskets, membranes and the new cell. The tie-rods are then removed from the hangers of the cells. All of the brackets are also removed from the lifting lugs. All inlet and outlet tubes required for electrolyte flow are then reconnected on the new cell.

It is preferred to visually inspect the membranes and gaskets at various times during installation to insure proper positioning and minimize damage to the membranes and gaskets.

In another embodiment of the present invention, jackscrews are removably fastened to the back of the top and bottom brackets so that the end of each of the jackscrews is against the end of each of the hydraulic pistons of each hydraulic cylinder.

In another embodiment, a shifter member (not shown) may be used in conjunction with the separator apparatus of the present invention. Once the hydraulic cylinders are pressurized to move the 5-cell blocks apart, the shifter can be used to move the cell frame member "X" between the 5-cell blocks as necessary. The shifter, for example, may be actuated to apply pressure on cathode side of cell frame member "X" which, in turn, pushes the cell frame member "X" against the 5-cell bracketed block of cells on its anode side or it may be actuated to apply pressure on the anode side of cell frame member "X" which, in turn, pushes the cell frame member "X" against the 5-cell bracketed block of cells in its cathode side.

The shifting of the cell frame member "X" by the shifter aids in removal of the gasket and/or the membrane on cathode or anode side of cell frame member "X".

After the membrane and gaskets on anode and cathode side of cell frame member "X" has been separated and removed from all around the cell frame member "X", the shifter can again be actuated to move the cell frame member "X" away from the adjacent cell and stopped when the cell frame member "X" is about half way between the two 5-cell blocks. The shifter is then moved away from the cell frame member "X". The cell frame member "X" is then in position to be removed from the electrolyzer cell series as described above.

What is claimed is:

1. A separator device for removing one or more cell frame members, gaskets or members from a plurality of cell frame members comprising:

a. at least a first bracket member for clamping a plurality of electrolysis cell frame members together;

b. at least a second bracket member for clamping a second plurality of cell frame members together; and c. at least a first hydraulic cylinder with a hydraulic cylinder rod interposed between the first and second bracket members for separating the first and second brackets apart whereby the cell frames are moved away from each other.

2. The separator of claim 1 including a threaded jack screw removably mounted to said second bracket member for adjustably moving against the hydraulic cylinder rod.

3. A process for removing one or more cell frame members, gaskets or membranes from a plurality of cell frame members comprising:

a. clamping a first plurality of cell frame members together;

b. clamping a second plurality of cell frame members together;

c. interposing at least a first hydraulic cylinder with a hydraulic cylinder rod between the first and second plurality of cell frame members; and d. actuating the hydraulic cylinder to separate the first and second plurality of cell frame members apart whereby the cell frames members are moved away from each other.

4. A shifter and flat plate electrolysis cell frame member removal device comprising:

a. a first top bracket for clamping a plurality of cell frame members together;

b. a second top bracket for clamping a second plurality of cell frame members together;

c. a first top hydraulic cylinder for separating the two sets of plurality of cell members;

d. a first top jack screw for taking up any gap between the top hydraulic cylinder and the top second bracket;

e. a first bottom bracket for clamping a plurality of cell members together;

f. a second bottom bracket for clamping a plurality of cell members together;

g. a second bottom hydraulic cylinder for separating the two sets of plurality of cell members; and h. a second bottom jack screw for taking up any gap between the top hydraulic cylinder and the top second bracket.

* * * * *